US006910766B2

(12) United States Patent
Haug

(10) Patent No.: US 6,910,766 B2
(45) Date of Patent: Jun. 28, 2005

(54) FRANKING MACHINE

(75) Inventor: Werner Haug, Langnau im Emmental (CH)

(73) Assignee: Frama AG, Lauperswil (CH)

( * ) Notice: Subject to any disclaimer, the term of this patent is extended or adjusted under 35 U.S.C. 154(b) by 783 days.

(21) Appl. No.: 10/009,681

(22) PCT Filed: Feb. 22, 2001

(86) PCT No.: PCT/CH01/00115

§ 371 (c)(1),
(2), (4) Date: Oct. 20, 2001

(87) PCT Pub. No.: WO01/62503

PCT Pub. Date: Aug. 30, 2001

(65) Prior Publication Data

US 2003/0007820 A1 Jan. 9, 2003

(30) Foreign Application Priority Data

Feb. 23, 2000 (CH) ..... 0345/00

(51) Int. Cl.[7] ..... B41J 2/01
(52) U.S. Cl. ..... 347/104; 101/91; 400/630
(58) Field of Search ..... 347/104, 2, 4, 347/220; 101/91, 92; 705/406; 400/630

(56) References Cited

U.S. PATENT DOCUMENTS 3,869,986 A * 3/1975 Hubbard ..... 101/91
4,821,049 A 4/1989 Eckl
5,166,883 A 11/1992 Gilham
5,648,811 A * 7/1997 Thiel et al. ..... 347/220
5,757,387 A * 5/1998 Manduley ..... 347/2
5,765,475 A * 6/1998 Salomon ..... 101/91
5,913,627 A 6/1999 Freeman et al.
6,007,178 A * 12/1999 Asano ..... 347/30
6,256,474 B1 * 7/2001 Gibisch et al. ..... 399/384
6,499,020 B1 * 12/2002 Dolan et al. ..... 705/406

* cited by examiner

*Primary Examiner*—Eugene H. Eickholt
(74) *Attorney, Agent, or Firm*—Friedrich Kueffner

(57) ABSTRACT

The invention relates to a franking machine, comprising at least one print head of an ink-jet printing mechanism for printing flat postal items such as letters or postcards, which can be introduced into said mechanism or which pass through the same. Said franking machine consists of a guiding part (39) which is located around the print head and projects in relation to the nozzle opening plane of said print head and with which a conveying device is associated, said conveying device transporting the postal items between itself and conveying rollers lying opposite and rotating about axes that are located crosswise to the conveying direction. Said conveying device has two drive-connected driving rollers (32, 33) which together with the guiding part (39), form a path of travel. The driving rollers are located in front of and behind the print head in relation to the conveying direction. A reversibly liftable counter-pressure roller (13, 15) located opposite exerts a pressure on each driving roller (32, 33), respectively, or on a postal item being transported in-between.

15 Claims, 8 Drawing Sheets

FRANKING MACHINE

Figure 1:
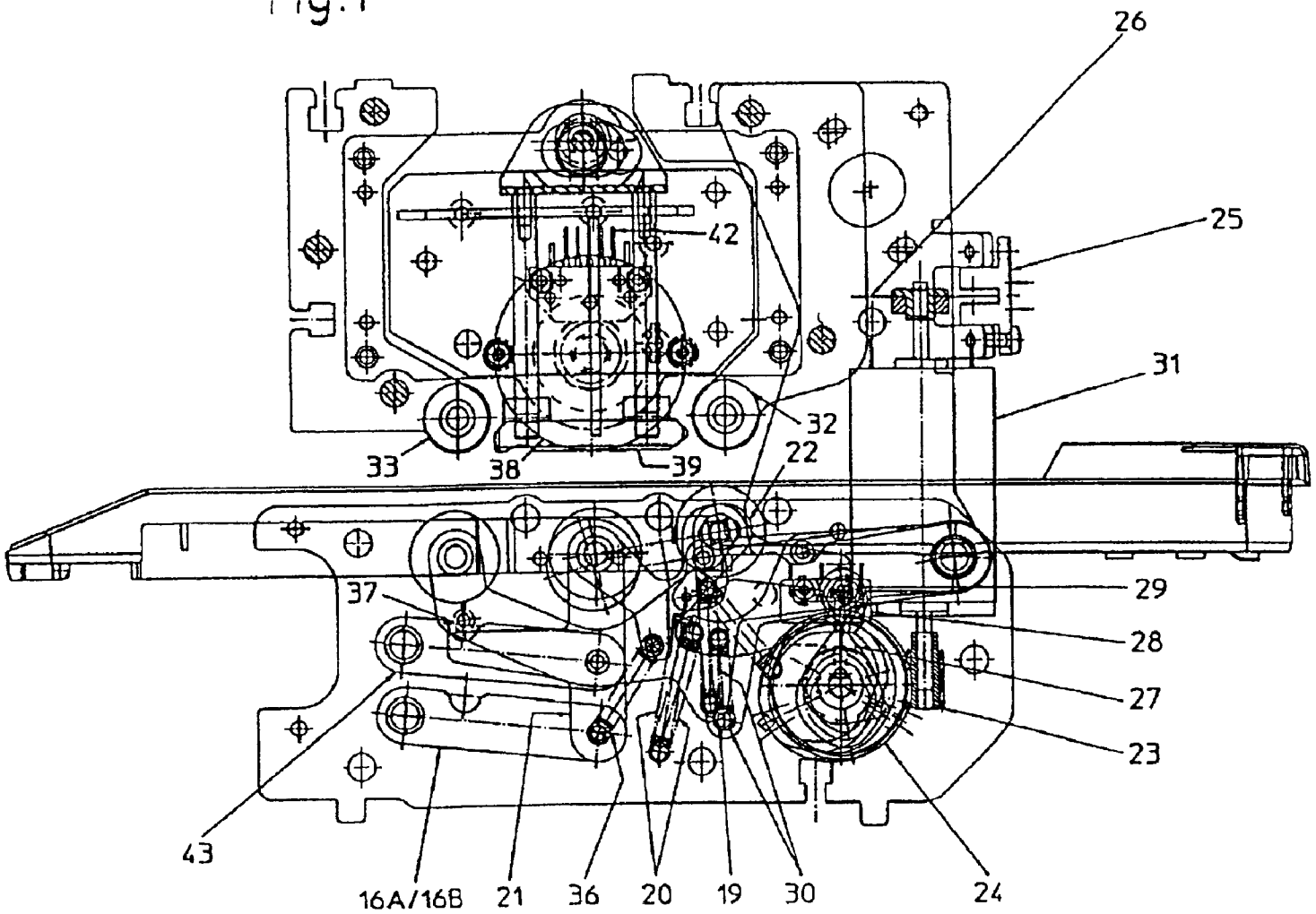

The invention relates to a franking machine with at least one print head of an inkjet printing mechanism for printing flat postal objects, such as letters or postcards, inserted into or passing through the machine, comprised of a guide part arranged so as to project from the print head and relative to its jet opening plane and having correlated therewith a transport device for transporting the postal objects between it and oppositely positioned conveying rollers rotating about axes oriented transverse to the conveying direction. The franking machines employ today in addition to the classical rotary printing technology increasingly new stamp application methods, inter alia, based on thermal or inkjet basis.

It has been shown in practice that not only the print head must be replaced, but depending on the printing technology the entire franking machine configuration is subject to greater and very complex, i.e., also correspondingly expensive, changes and modifications.

Inkjet print heads have been known for quite some time and are used, in particular, in PC printers. The knowledge that has been gained for use of such print heads in this field cannot be transferred onto the present field of use in franking machines. The reasons, inter alia, lie in the high speed of the letters undergoing franking as well as their different formats and thicknesses as well as the considerably rougher conditions of the surroundings, caused partially by soiled surfaces of the postal objects. Moreover, these franking prints must fulfill strict quality requirements of the postal offices, which make necessary high construction expenditure and reliability.

The object of the present invention resides in that the franking machine is to be configured such that it enables, provided with an inkjet print head, as much as possible a disruption-free printing for the franking of postal objects, such as letters, cards or the like of different thickness, different formats and materials, and produces an unequivocally identifiable print image. Since presently such machines must enable high throughput, a fully automated operation is also required.

Special importance therefore resides in the guiding of the postal objects in the area of the print head. Since from the thinnest A objects (essentially a single sheets) to a thick letter, a wide range of postal objects with most different mechanical properties—for example, bending behavior—as well as most different formats are to be printed or provided with franking, during the entire printing phase the spacing of the jet opening plane of the inkjet print head relative to the object surface to be printed must be constant. Moreover, conditions are to be provided which ensure a robust configuration, reliability, and low-maintenance configuration.

In addition to these requirements a robust embodiment, reliability, low-maintenance configuration, and high-quality of the print image are to be fulfilled.

According to the invention this object is solved in that the transport device comprises two drive rollers connected in driving connection with one another and forming together with the guide part a conveying path, which drive roller, when viewed in the conveying direction, are arranged before and behind the print head and in that a counterpressure roller is arranged opposite thereto, respectively, which exerts a pressure against the drive roller or the postal object to be transported therebetween and which is reversibly liftable. With these measures, high precision during printing of the postal objects and a high-quality economical manufacture as well as a simple operation can be obtained with the franking machine according to the invention.

In the following, the functions and the configuration as well as advantages of an embodiment of the franking machine according to the invention with inkjet printing technology will be described. The description is limited primarily in this context to the technical features for printing the postal object during the transport in the franking machine.

For a better understanding, reference is being had to the reference numerals and Figures in which embodiments of the invention are illustrated.

1A forward control curve for right counterpressure roller
1B rear control curve for right counterpressure roller
2A forward control curve for left counterpressure roller
2B rear control curve for left counterpressure roller
3 main shaft
4 rear sidewall
5 forward sidewall
6A counterpressure lever, left, front
6B counterpressure lever, left, rear
7A control lever, left, front
7B control lever, left, rear
8A counterpressure lever, right, front
8B counterpressure lever, right, rear
9A control lever, right, front
9B control lever, right, rear
10 axle for counterpressure lever and control lever
11 stop bolt for counterpressure lever—right
12 stop bolt for counterpressure lever—left
13 counterpressure roller—right
14 support roller
15 counterpressure roller—left
16A linkage, front, for support roller
16B linkage, rear, for support roller
17 axle for linkage
18 rod for suspending spring
19 suspension location for spring
20 tension spring for control lever
21 support roller carrier with sensor member
22 cam follower
23 worm shaft
24 worm gear
25 forked light barrier
26 slotted disk
27 switching cam for initial position of main shaft
28 microswitch
29 control roller
30 tension spring for counterpressure lever
31 direct-current motor
32 drive roller, right
33 drive roller, left
34 axle for counterpressure roller, right
35 stop for cam follower
36 tension spring for cam follower
37 stop for sensor member
38 sensor wheel for incremental transponder
39 holding-down plate or guide part
40 drive motor for feed
41 gearbox for drive rollers
42 incremental transponder, encoder
43 projecting member on support roller carrier

DESCRIPTION OF THE DRAWING OF THE FOLLOWING FIGURES

Figure 2:
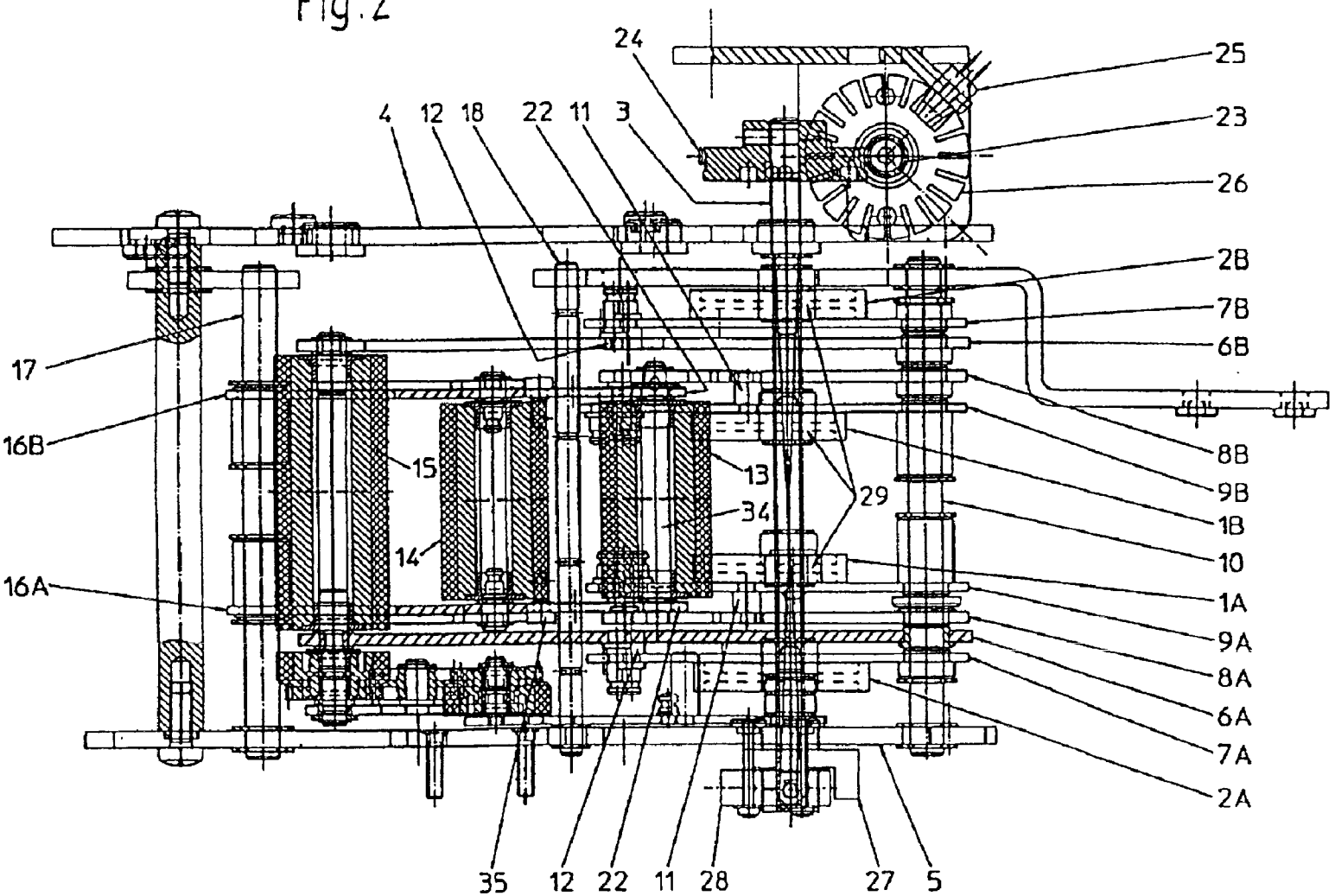
Figure 3:
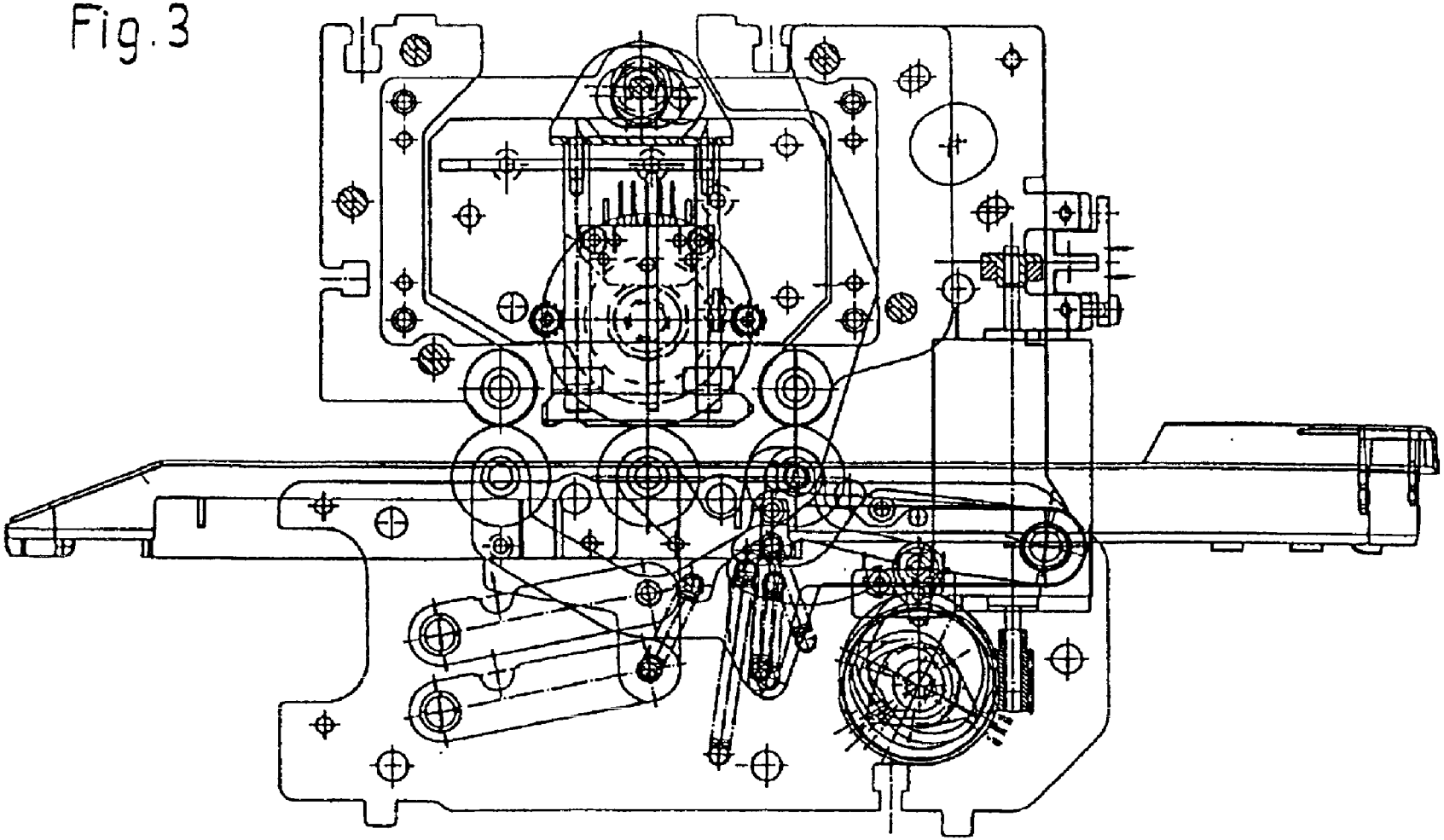
Figure 4:
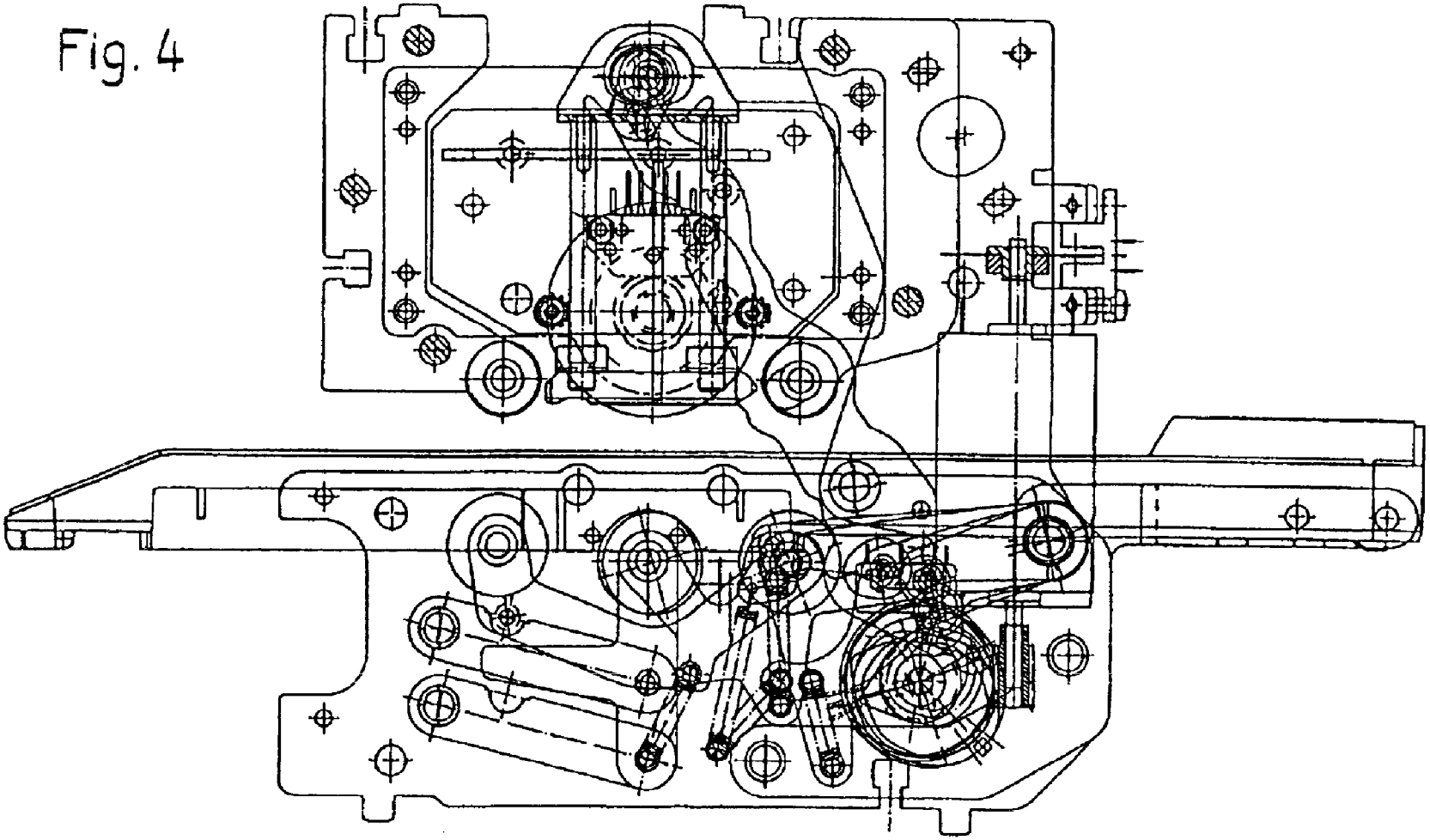
Figure 5:
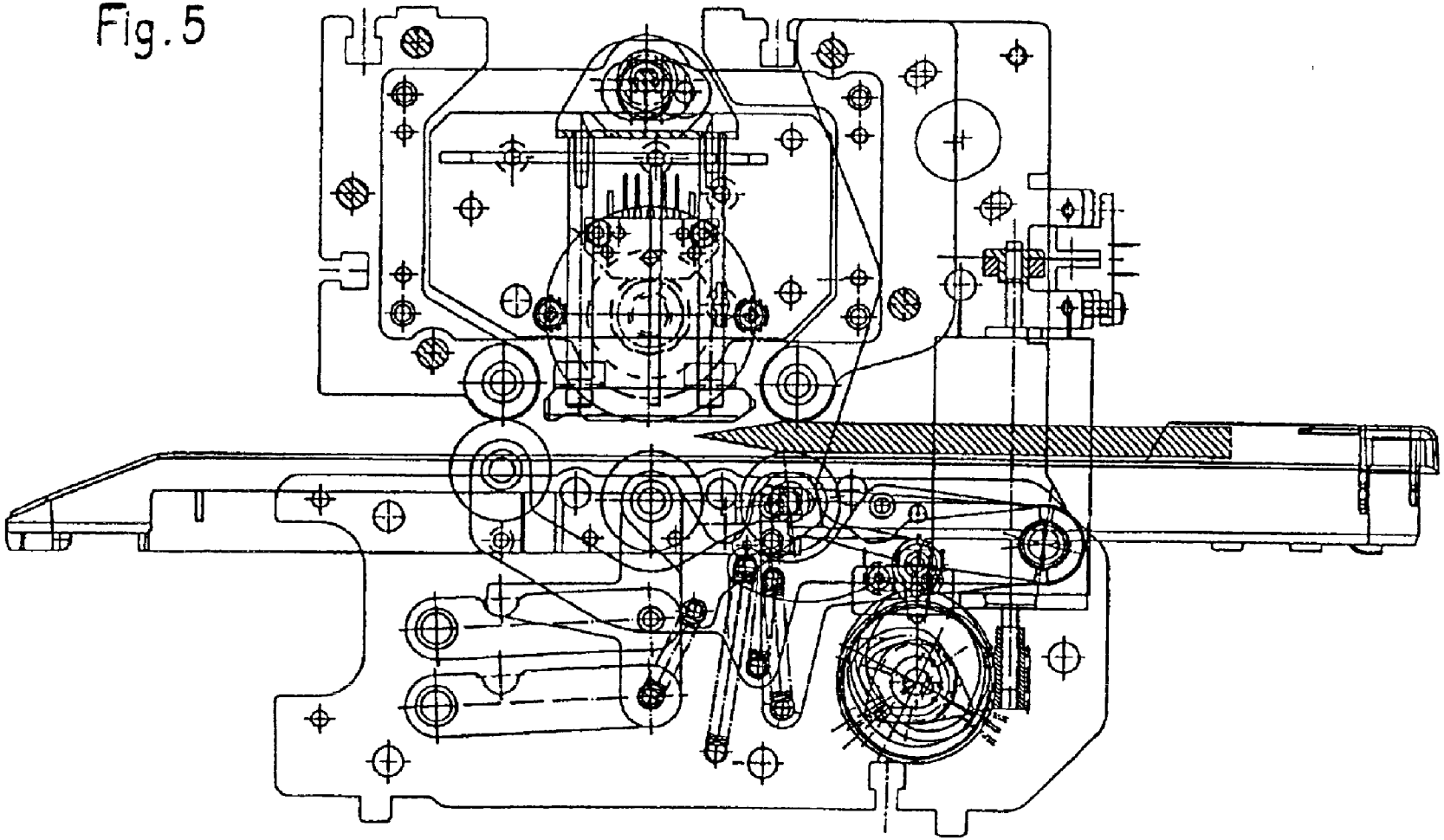
Figure 6:
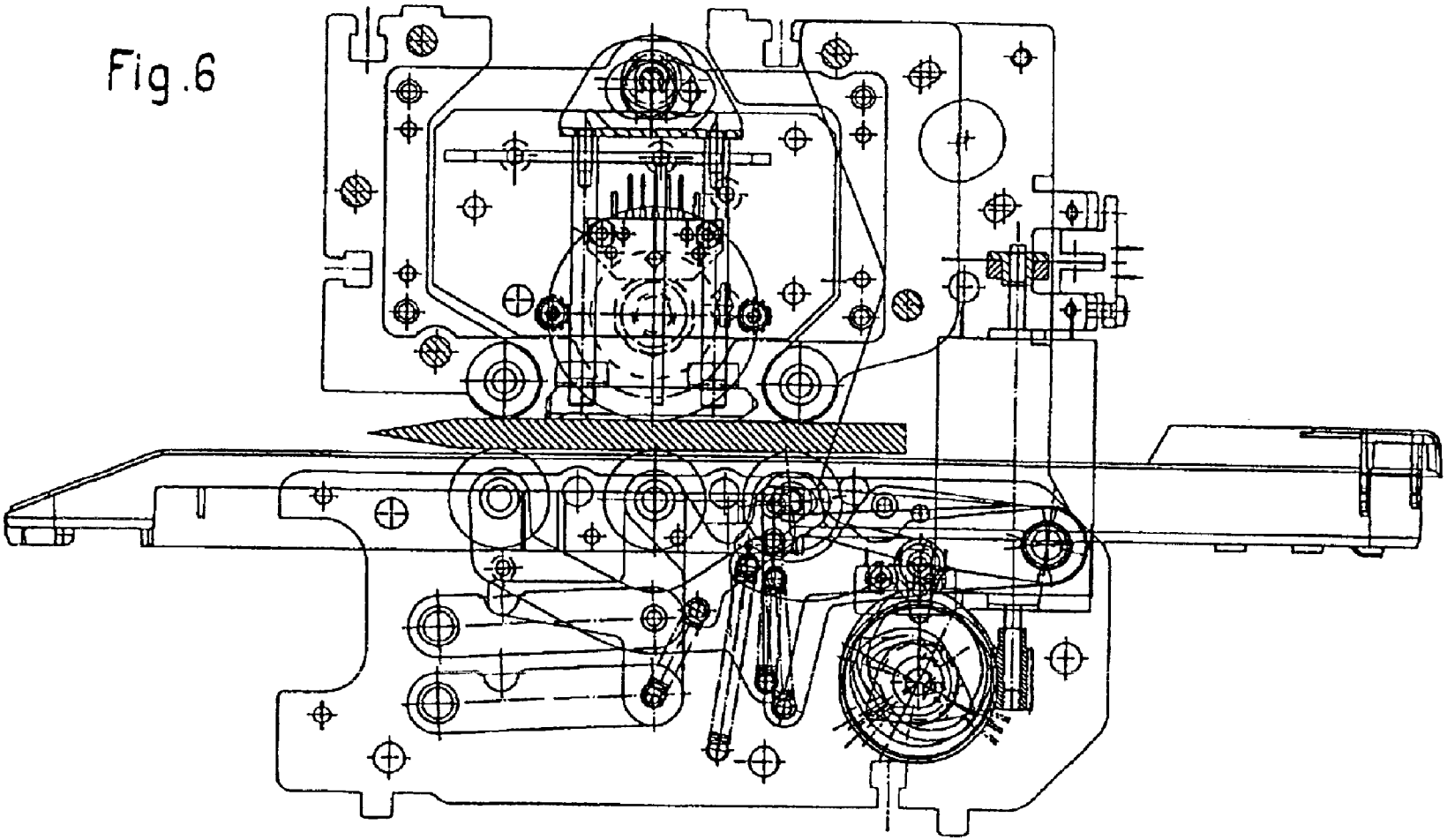
Figure 7:
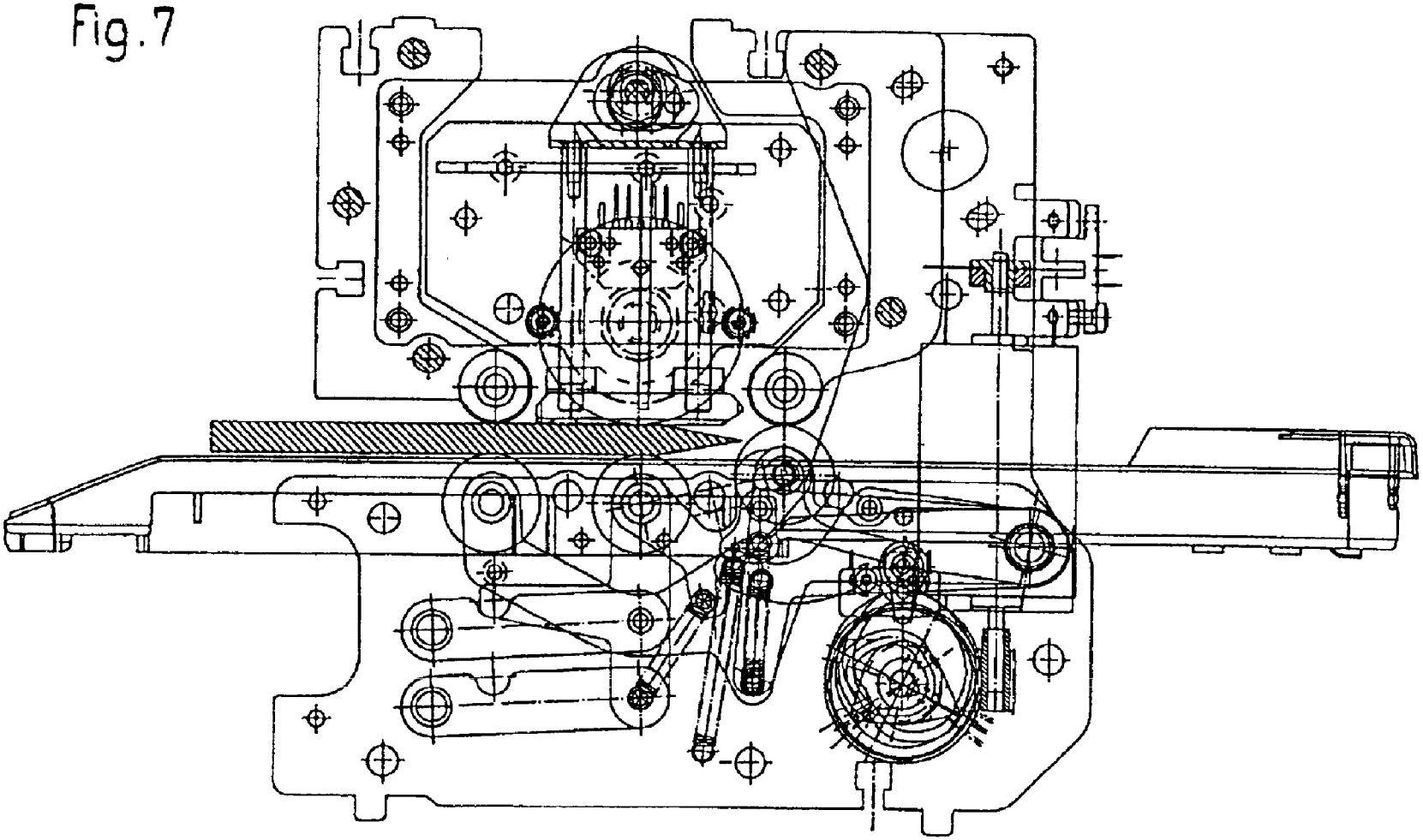
Figure 8:
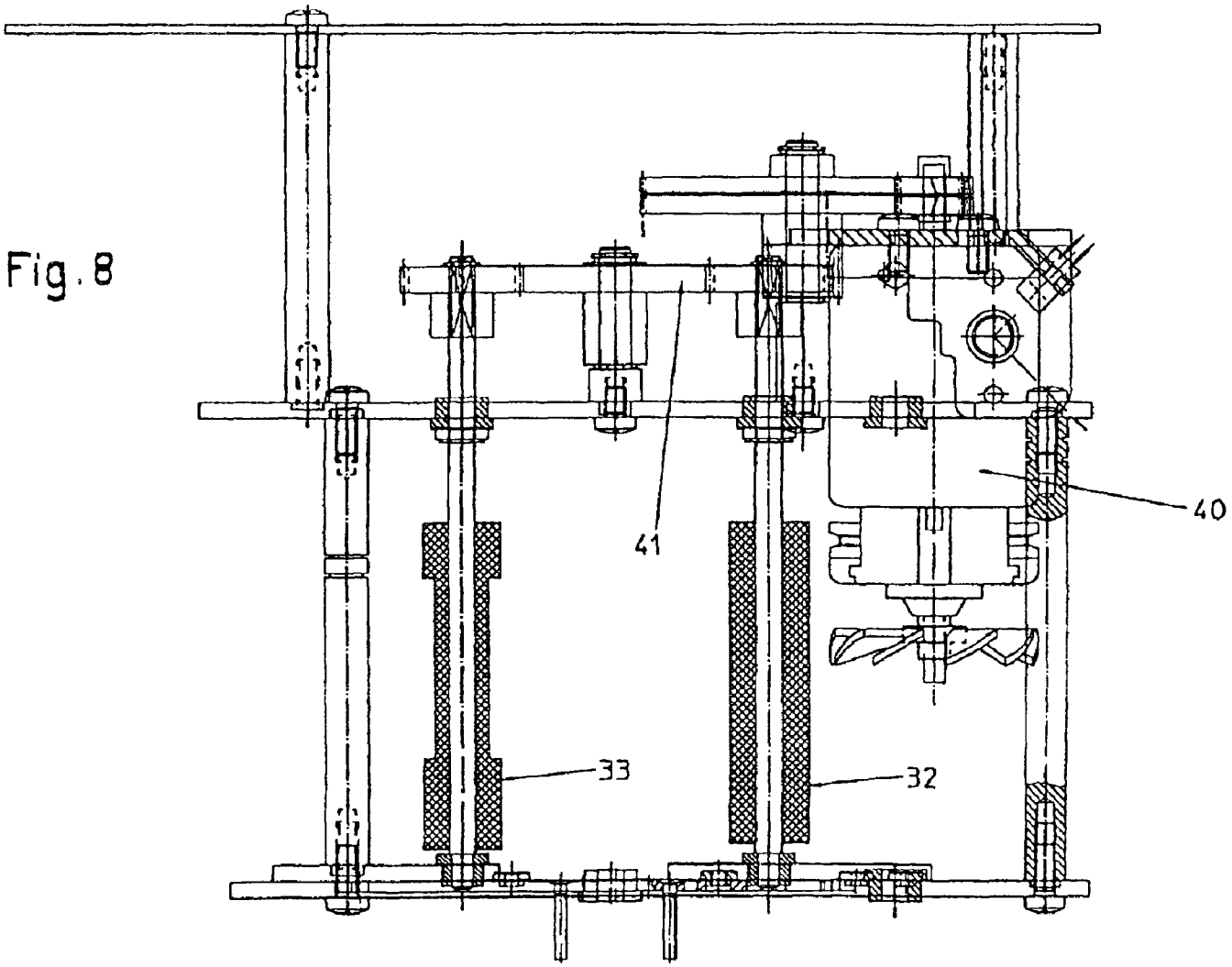

FIG. 1 front view of the complete counterpressure mechanism, including drive, sensor wheel, and main shaft drive;

FIG. 2 plan view onto counterpressure mechanism according to FIG. 1;

FIG. 3 front view of the complete counterpressure mechanism in franking position, counterpressure arrangement in upper position;

FIG. 4 front view of the complete counterpressure mechanism in service position, counterpressure arrangement in lowermost position;

FIG. 5 front view, position of counterpressure lever/rollers with inserted thick short letter or letter being fed from the right by automatic feeding into a position under the right drive roller;

FIG. 6 front view, thick letter underneath all drive rollers and the sensor wheel;

FIG. 7 front view, thick letter has left the right roller, the right counterpressure roller automatically reaches the upper position, the central support roller remains at the initial height level. The left counterpressure roller has taken over the height sensing; and FIG. 8 plan view, drive rollers with feed gear mechanism.

In the case of franking of individual letters, the letter is inserted manually into the franking machine which is in its initial position. Photo cells start the franking process when the envelope is correctly positioned. The counterpressure rollers which are in a lower position upon insertion of the envelope are moved upwardly by the control curves on the main shaft and press the letter object against the upper drive rollers. The letter transport or the franking process can now be started.

The counterpressure arrangement is comprised of three counterpressure rollers. Two rollers are positioned under the right and left drive rollers. The third, central roller has the object to move the letter to the required height level under the print heads without pressing the letter against the end faces of the print heads so that the print image remains clean without smearing. After the franking process, the counterpressure rollers move again downwardly and release the gap for the insertion of a new envelope.

In addition to the insertion and franking position of the counterpressure rollers, there is also a position "service". In this position the counterpressure rollers are moved farther downwardly in order to provide room for the service station. The service station cleans and closes the print heads for longer work interruptions or during transport of the franking machine. Moreover, it is required for filling the print heads when changing the ink bag.

Construction and Function Descriptions of the Transport Device On the main shaft 3 several control curves 1A, 1B and 2A, 2B are arranged which lift or lower, depending on the required position, the control levers 7A, 7B and 9A, 9B via the control rollers 29 so as to be pivoted about the axle 10. The initial position of the main shaft 3 is found by the microswitch 28 switched by the control cam 27. By means of the motor 31 the worm gear mechanism 23/24 is driven and the main shaft is rotated into the position "insertion of letter", "franking", or "service position". The precise position is reached by a forked light barrier 25 and the slotted disc 26 seated on the motor shaft by means of electronic control—as a result of the number of triggered pulses. The counterpressure levers to the right and left 6A, 6B and 8A, 8B are pivoted by the tension springs 30 connected to the control levers 7A, 7B and 9A, 9B in the upward direction about the axle 10 until the counterpressure rollers 13, 15 come to rest against the upper drive rollers 32, 33. The control levers 7A, 7B and 9A, 9B reach their end positions via the control curves 1A, 1B and 2A, 2B which has the result that the tension springs 36 are further pretensioned by a small amount. The safe contact between the control rollers 29 and the control curves 1A, 1B and 2A, 2B is achieved by the tension springs 29 connected to the spring suspension rod 18. The precise lower position of the counterpressure levers 6A, 6B and 8A, 8B is reached at the stop bolts 11, 12 on the control levers which are supported on the counterpressure levers after a short return stroke and entrain them in the downward direction. The corresponding positions are illustrated in detail in the Figures.

The support roller 14 positioned at the center which moves the letter to an exact spacing relative to the inkjet print heads is seated rotationally supported on two support roller carriers 21 which are, in turn, supported by means of two parallelogram linkages 16A, 16B. The cam follower 22 seated on the rotation axle of the support roller 14 is connected to the axle 34 of the right counterpressure rollers 13 and is forced to move in the downward direction when lowering the right counterpressure lever 6A, 6B and reaches the level of the right counterpressure roller. The cam follower 22 is supported via the stop 35 against the support roller carrier 21 rigidly in regard to rotation to the left. With regard to rotation to the right, the cam follower 22 can rotate away from the stop 35 counter to the force of the tension spring 36. This is required because of the mutual sensing between the right and the left counterpressure roller and will be described in more detail later on.

Description to FIGS. 1 to 8

The counterpressure levers 6A, 6B; 8A, 8B are in the initial position ready for insertion of an individual letter. As soon as the letter is positioned in an exact position to the rear and the right defined by the table stop, the franking machine is activated by means of a reflective light barrier. First the main shaft 3 rotates about approximately one-third revolution in the clockwise direction. The control levers 7, 9 are pivoted upwardly by the control rollers 29 by means of the control curves 1, 2. The counterpressure levers are also moved upwardly via the tension springs 30 until the counterpressure rollers 13, 15 rest against the drive rollers 32, 33. The control levers move still farther until the control curve has reached its highest point. The possible overstroke of the control lever is compensated by the sprung coupling of the counterpressure levers. The support roller 14 has been adjusted by means of the cam follower 22 to the same level. The letter is now clamped between the drive rollers and the counterpressure rollers. The drive motor 40 (see FIG. 8) drives via the gear mechanism 41 the drive rollers 31, 33 and moves the letter from the right to the left. The speed and position detection is realized by the incremental transponder 42 and the sensing wheel 38. The sensing wheel is driven by friction by means of the moving letter envelope and detects thus the precise speed of the letter surface. The pressing of the letter against the sensing wheel is realized by a separate counterpressure arrangement which will be described separately in the following. As a function of the letter position, the inkjet print heads spray corresponding line patterns which result in the desired print image. The holding-down plate or the guide part 39 secures the letter at an exact spacing to the print head end face in order to enable with respect to resolution a clean print image and, furthermore, to prevent that the printed lines smear when moving the envelope. After completion of the franking process the drive motor is switched off and the main shaft returns by rotation into its initial position; the counterpressure levers reach again their initial position. A new letter can be inserted. The main shaft 3 rotates between the position "insertion" and "franking" only by approximately one-third revolution back and forth, which provides a considerable time advantage and moreover is gentle on the mechanism. After a further one-third revolution the counterpressure rollers have reached their absolute lowest position as is required in the service position (see FIG. 4). Movement back into the initial position "insertion" requires also only one-third revolution.

In FIG. 5 the function of the cam follower 22 in connection with the right counterpressure roller 13 is illustrated. The necessity of this function is described in the following. The initial position is characterized by a relatively thick short envelope which is inserted manually. The franking machine triggers the franking process. The counterpressure levers move, as described, in the upward direction. The thickness of the short letter limits the stroke of the right counterpressure roller in the upward direction. The letter is clamped by means of the spring force that is built up by the tension spring 19 between the upper right drive roller 32 and the counterpressure roller 13. This is necessary in order to ensure a slip-free drive. If the support roller 14 were not moved automatically by means of the cam follower 22 to the same height level, the thick envelope could not be clamped between the upper stationary holding down plate or the guide part 39 and the support roller; this would result in transport problems and printing quality loss. By means of the already described cam follower 22 the support roller carrier with support roller is moved to the height level of the right counterpressure roller. The support roller carrier moves synchronously in the form of a parallelogram with the right counterpressure roller in the downward direction and the envelope can pass without friction through the printing station.

In FIG. 6 the illustration shows the thick letter having been moved also under the left drive roller. The left counterpressure lever had to move also in the downward direction counter to the spring force and has reached the same height level as the right counterpressure lever or the central support roller. The stop 37 of the left counterpressure roller has contacted the sensing member of the support roller carrier 21.

In FIG. 7, the letter has left the right drive roller and the right counter roller moves again upwardly until the counterpressure roller contacts the upper drive roller. The stop 37 of the left counterpressure roller rests against the member 43 of the support roller carrier 21 and secures it now at the original height level. The right cam follower 22 can fold out by rotating to the left and the connecting point can follow the right counterpressure roller until the counterpressure roller rests against the upper right drive roller. The height sensing of the support roller is realized alternatingly between the right and left counterpressure roller and ensures thus over the entire letter length an optimal friction-free passage relative to the print heads and a friction-optimized spacing relative to the holding-down plate or the guide part.

What is claimed is:

1. Pranking machine with at least one print head of an inkjet print mechanism for printing flat postal objects such as letters or postcards insertable into or passing through the machine, comprised of a guide part (39) arranged so as to project about the print head and further relative to its jet opening plane, having correlated therewith a transport device for transporting the postal objects between it and oppositely positioned conveying rollers rotating about axes oriented transverse to the conveying direction, wherein the transport device has two drive rollers (32, 33) connected in driving connection with one another and forming together with the guide part (39) a conveying path, which, when viewed in the conveying direction, are arranged before and behind the print head and in that a counterpressure roller (13, 15) is arranged opposite thereto, respectively, which exerts a pressure against one drive roller (32, 33) or the postal object to be transported therebetween and which is reversibly liftable.

2. Machine according to claim 1, wherein between the counterpressure rollers (13, 15) a support roller (14) is arranged which is connected to at least one of the liftable counterpressure rollers (13, 15) and adjustable with respect to the spacing of the guide part (39).

3. Machine according to claim 2, wherein at least one of the counterpressure rollers (13, 15) and the support roller (14) can be moved into an insertion position, a franking position, or a servicing position.

4. Machine according to claim 2, wherein the counterpressure rollers (13, 15) are supported, respectively, on controlled counterpressure lever pairs (6A,6B; 8A,8B) which have a common pivot axle (10).

5. Machine according to claim 4, wherein the support roller (14) is connected by a cam follower pair (22) with at least one of the counterpressure lever pairs (6A,6B; 8A,8B).

6. Machine according to claim 4, wherein the counterpressure lever pairs (6A,6B; 8A,8B) are connected by a driving connection with a control curve pair (1A,1B; 2A,2B), respectively, arranged on a motorically driven main shaft (3) and can be moved into a transport-active position.

7. Machine according to claim 2, wherein the counterpressure rollers (13, 15) and the support roller (14) can be controlled so as to be lowered simultaneously.

8. Machine according to claim 1, wherein the counterpressure lever pairs (6A,6B; 8A,8B) are connected by tension springs (36) with a counter control lever pair (7A,7B; (9A, 9B) supported on the control curve pairs (1A,1B; 2A,2B).

9. Machine according to claim 8, wherein the control lever pairs (7A,7B; 9A,9B) are supported on the pivot axle (10).

10. Machine according to claim 9, wherein the control lever pairs (7A, 7B; 9A,9B) are supported against spring force by means of control rollers (29) on the control curves (1A, 1B; 2A,2B).

11. Machine according to claim 8, wherein the lower position of the counterpressure roller pairs (6A, 6B; 8A, 8B) is defined by a stop (11, 12) fastened on the control lever pairs (7A,7B; 9A,9B).

12. Machine according to claim 5, wherein the support roller (14) is supported on a support roller carrier pair (21) connected to the control lever pair (7A, 7B).

13. Machine according to claim 12, wherein the support roller carrier pair (21) is connected at the end facing away from the support roller (14) with a parallelogram linkage pair (16A, 16B) and at the support roller end with the counterpressure roller (13) by means of the cam follower pair (22).

14. Machine according to claim 13, wherein the cam follower pair (22) is connected by tension springs with the free end of the parallelogram linkage pair (16A, 16B).

15. Machine according to claim 14, wherein the counterpressure lever pair (6A, 6B) is supported in the area of the counterpressure roller (15) on the parallelogram linkage pair (16A, 16B).

* * * * *